US006263876B1

(12) United States Patent
Butts

(10) Patent No.: US 6,263,876 B1
(45) Date of Patent: Jul. 24, 2001

(54) SEIZURE PILLOW AND METHOD OF USING SAME

(76) Inventor: Loice Butts, 6834 Knollcrest Dr., Harrison, TN (US) 37341

( * ) Notice: Subject to any disclaimer, the term of this patent is extended or adjusted under 35 U.S.C. 154(b) by 0 days.

(21) Appl. No.: 09/523,129

(22) Filed: Mar. 10, 2000

(51) Int. Cl.[7] ..... A61G 15/00

(52) U.S. Cl. ..... 128/845; 128/846; 5/632; 5/636

(58) Field of Search ..... 128/845, 846, 128/869, 870; 5/630, 632, 636

(56) References Cited

U.S. PATENT DOCUMENTS 1,549,601 * 8/1925 Mulgrew ..... 128/845
5,433,689 * 7/1995 Frins ..... 128/845
5,893,183 * 4/1999 Bechtold ..... 5/632
6,050,265 * 4/2000 Richardson ..... 5/636

* cited by examiner

*Primary Examiner*—Michael A. Brown
(74) *Attorney, Agent, or Firm*—Pendorf & Cutliff

(57) ABSTRACT

A seizure pillow and method of using same including for supporting the head of a person experiencing a seizure or convulsion, and includes a base member with a handle, the handle has a timing device, and positioned on the base member is a pillow body with a cover.

19 Claims, 2 Drawing Sheets

SEIZURE PILLOW AND METHOD OF USING SAME

BACKGROUND OF THE INVENTION

1. Field of the Invention

The present invention relates to a seizure pillow and method of using same and more particularly pertains to a portable pillow that is extremely useful for persons suffering from seizures.

2. Description of the Prior Art

The use of a pillow to support the head is known in the prior art. More specifically, pillows heretofore devised and utilized for the purpose of being used as a sleep aid, medical apparatus, monitoring device and a general head support are known to consist basically of familiar, expected and obvious structural configurations, notwithstanding the myriad of designs encompassed by the crowded prior art which have been developed for the fulfillment of countless objectives and requirements.

There are persons in our society who frequently experience a seizure or convulsion. The seizure or convulsion episode can be mild or major. During a major seizure/convulsion episode, a sudden, violent, uncontrollable contraction of a group of muscles occurs. During the seizure/convulsion episode, the person generally loses consciousness and body controls, resulting in them lying on the floor or other surface. For the person observing the seizure, it is important that they note physical changes in the body, the duration of the seizure, and keep the person experiencing the seizure away form harmful furniture and object. One major thing for the observer to do is to properly position the head so that the airway of the neck remains open. Further, the observer of the seizing person must not try to restrain the body, especially the head. Any support to the head must allow free movement.

Currently, if the person goes into a seizure, away from a medical facility, there is no ready means to time the episode, nor are there any head support devices around. Therefore, for persons who are prone to have seizures on a regular basis, there is a need for a quick and available device to aid in timing of the seizure and supporting the head during the seizure. A conventional, one-piece pillow, filled with feathers, cotton, foam, or any other stuffing material, which are still prevalent, has been used in the past. However, conventional pillows are not always available and do not provide the best support for the head.

We now describe the conventional pillow and supporting pillows. The standard foam pillow has a depression to take the head in the central region and further a bead to support the neck. There are pillows that have more that one stuffing material; most often there is only a second stuffing. One of the stuffing materials can be rigid or semi-rigid, and the other stuffing material may be made of a more flexible material. Generally, pillows have a rectangular cross-section with the stuffing being consistent throughout the pillow, or the stuffing is comprised of different material. The conventional pillow has been reshaped and designed to meet a variety of physical needs of the human body. An overwhelming number of those prior art pillows are designed to support a person's head and neck. The remaining prior art pillows are used to support various other body parts. Though many conventional pillows are used as support pillows, they are generally not easy to transport and place under the head of the person experiencing a seizure. Nor do the conventional pillows come with a device that times the seizure. Further, the varieties of support pillows on the market are not specifically concerned with supporting the head of the person experiencing the seizure, and meeting their special needs.

By way of example, the prior art includes U.S. Pat. No. 6,006,380, the adjustable cervical pillow with depressions for a user's ear, and supports the head and neck of a person. Specifically, the '380 patent is a pillow for use during sleep and has therapeutic and cosmetic properties which prevent morning wrinkles and ear compression. The '380 pillow is made of resilient material with the pillow body formed of an adjustable height headrest. The adjustable height headrest may be made of a plurality of height adjustment shims.

The support pillow of U.S. Pat. No. 5,261,420 is used by severely disabled persons to maintain them in an erect posture. This pillow of '420 has a frontal element that rests beside the patient's chest and a chin support. This pillow should not be used with the seizing person because it restricts movement. Restricting the body of the seizing person can cause additional harm.

The anti-snore pillow of Des. 415,920 is generally rectangular like most pillows. In the figure shown, it has an upper first flat portion and a second portion extending from the flat portion at a specified elevation above the flat portion. If the second portion is placed under the neck or behind the head of the seizing person, it may interfere with the airway.

The following U.S. Patents show the variety of support pillows, none of which supports the head. U.S. Pat. No. 6,006,381 is a support pillow that is structured to support premature infants in a variety of positions. U.S. Pat. No. 5,989,193 teaches a device and method for detecting and recording snoring. The '193 patent places a pillow-like device within a mattress and directly under the sleeping person's torso. Lastly, U.S. Pat. No. 4,683,601 is a medical pillow that is positioned over the chest of a person who has recently undergone open heart surgery. The pillow in the '601 patent has places for the person's arms to assist with holding the pillow in place in front of the chest. The above-cited prior art support pillow, as stated earlier, demonstrates the vast use of support pillows with the human body.

Even though conventional pillows are used by seizure sufferers at home or in medical facilities; they do not meet the specific needs. Further, none of the cited references address the needs of a seizing person, that is, to allow ease of pillow placement without interfering with the seizure episode, and the ability to time the seizure.

The inventor has noticed, through experience, that the vast majority of seizure sufferers receive head injuries when they experience the seizure from outside of their known environment. Secondly, they have no means to time the seizure episode. Timing of the episode provides needed information to the medical professional striving to provide treatment for control of the seizure.

Therefore, it can be appreciated that there exists a need for a pillow for use by seizing persons which can be used by the person observing the seizure without interfering with the body's movement during the episode and allow for ready timing of the episode.

SUMMARY OF THE INVENTION

The present invention provides a device for supporting the head of a seizing person while timing the seizure episode.

After extensive study and testing of conventional pillow designs, the present inventor discovered that conventional pillows were not always available when needed by the seizing person. Further, conventional pillows could not be easily placed under the head of the seizing person while they were experiencing the seizure/convulsion.

Accordingly, a primary purpose of the seizure pillow is to provide a portable support pillow that can be used by persons suffering from seizures, to support the person's head and provide a timing device. As such, the general purpose of the present invention will be described subsequently in greater detail.

To attain this, the present invention essentially comprises a base member formed of a semi-rigid to rigid wood or plastic. The base member has a handle portion interconnected thereto. The handle extends outwardly from a periphery of the base member. Positioned on the base member is a resilient pillow body. The pillow body is positioned about a first portion of the base member. The pillow body is designed so that it can be easily slid under the head of the seizing person. To protect the pillow body from contamination by body fluids, the resilient pillow body has a water repellant covering.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a pillow that can support the head of a seizing person to reduce injury to the head.

Another object of the present invention is to provide a pillow which may be easily used by persons witnessing the seizure and allow for placement under the seizing person's head without a handling of the head for an extended period of time.

A further object of the present invention is to provide a seizure pillow and a timer device for timing the seizure episode.

A further object of the invention is to provide a seizure pillow, which is of a durable and reliable construction.

An even further object of the present invention is to provide a seizure pillow which is susceptible of a low cost of manufacture with regard to both materials and labor, and which accordingly is then susceptible of low prices of sale to the consuming public, thereby making such seizure pillow economically available to the buying public.

Still yet another object of the present invention is to provide a method of using the seizure pillow that is easy for the bystander to place under the person's head and easy for setting the timer.

These, together with other objects of the invention, along with the various features of novelty which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
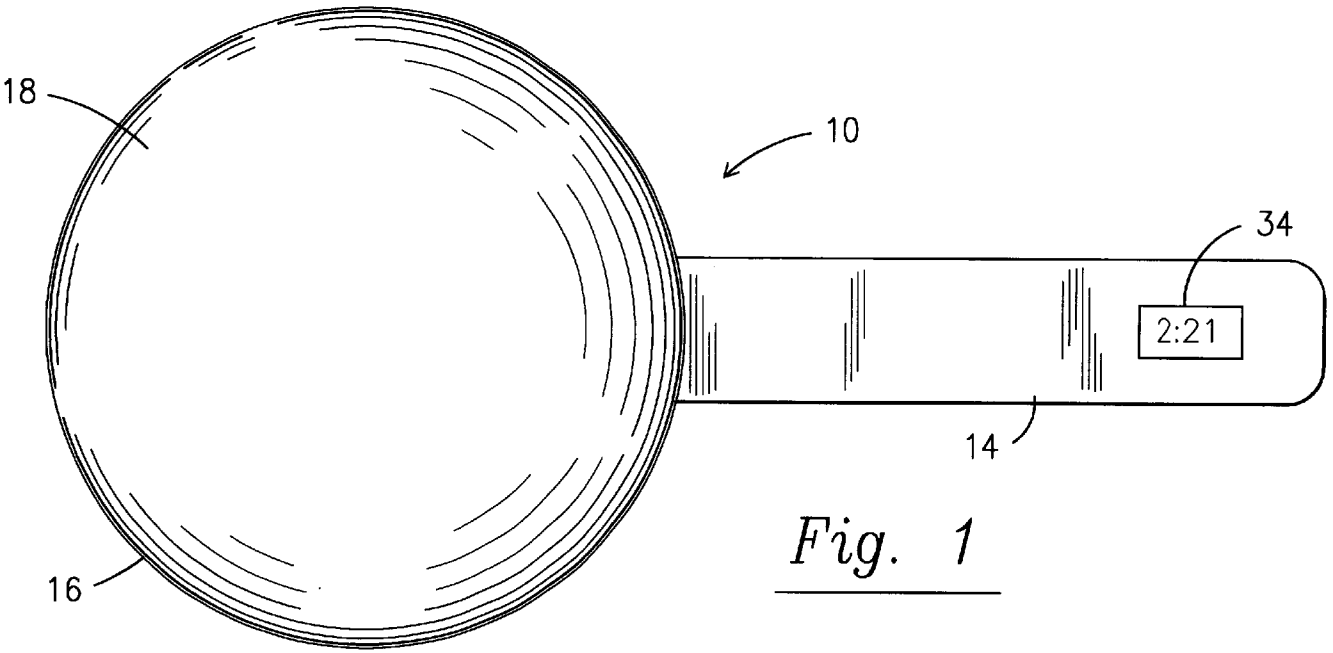
FIG. 1 is a perspective illustration of the preferred embodiment of the seizure pillow constructed in accordance with the principles of the present invention.

With reference now to the drawings, and in particular to FIG. 1 thereof, a seizure pillow embodying the principles and concepts of the present invention and generally designated by the reference numeral 10 will be described.

The present invention, seizure pillow, is comprised of a plurality of components. Such components in their broadest context include a base member with an attached handle and a pillow body. Such components are individually configured and correlated with respect to each other so as to attain the desired objective.

Figure 2:
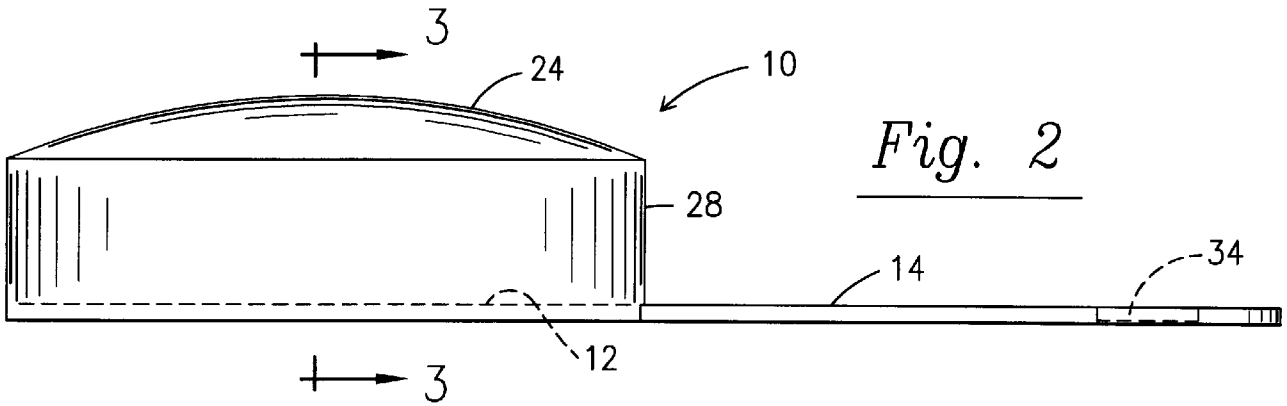
FIG. 2 is a side view of the seizure pillow of FIG. 1.
Figure 3:
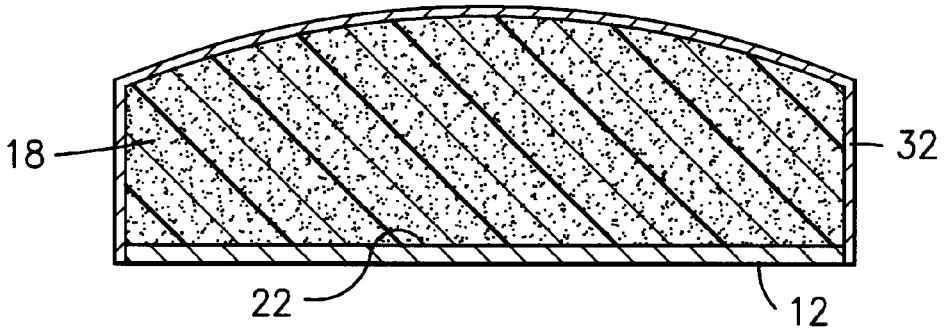
FIG. 3 is a cross-sectional view of the seizure pillow taken at lines 3—3 of FIG. 2.

More specifically, the present invention includes a base member 12 and a handle portion 14, as shown in FIG. 2. The handle portion is interconnected to the base member and extends outwardly from a peripheral side 16 of the base member. The base portion and handle are formed of a semi-rigid to rigid material that has a low specific gravity. This makes the seizure pillow easy to carry around. The material used is either a wood or a plastic.

Positioned about the base member is a resilient pillow body Specifically, the pillow body is positioned about a first portion 22 of the base member. The pillow body is sized to receive the head of the seizing person. The resilient pillow body has a raised central portion 24 sloping downwardly toward an edge of the peripheral wall 28 of the pillow body. The raised central portion provides additional support to the head as it moves about during the seizure episode. The sloping of the central portion makes it easier to slide the pillow under the head of the seizing person.

Further, the resilient pillow body is made of a natural material such as cotton or a man made material such as foam or a Memory Foam®. The preferred foam material can be one or a combination of one or more of the following foams, urethane, polyurethane, polyethylene polyvinyl chloride, polyvinyl chloride/nitril blend, or synthetic sponge rubber.

The foam can be in the form of a pre-cut shape or shredded foam pieces retained in a fabric encasement.

A covering 32 is provided for the resilient pillow body. The covering must be a fabric that can be easily cleaned. The seizing person may drool or vomit during the episode. The covering is made of a water repellant textile fabric that may be made by various processes. The term "water repellant" as used herein means essentially impermeable to water, i.e. treated textile can support a considerable column of water without water penetration through the fabric. The covering may be synthetic polymer textiles such as polyesters, nylon and polyamides, synthetic leather, polyvinylchloride (vinyl), fabric treated with wax-like polymer or wax emulsions, or a fabric treated with a fluorochemical.

As depicted in FIGS. 1 and 2, the handle of the base member supports a timing device 34. The timing device provides an immediate source for timing the seizure or convulsion. The medical professional treating the person suffering from such a condition needs constant information on each and every seizure the person experiences. Information on the severity and length of the seizure helps the treating physician determine whether the medication being taken by the disabled person, is adequately controlling the seizure episodes.

Figure 4:
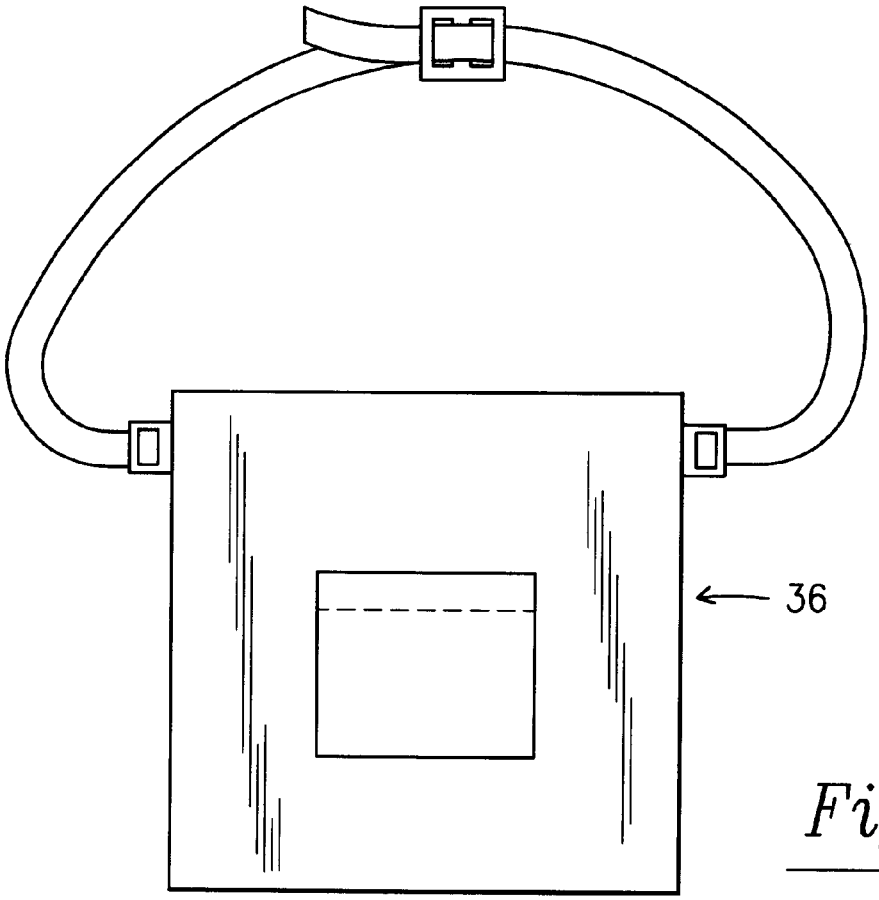
FIG. 4 is frontal view of the seizure pillow carrying bag.

For the conveyance of the seizure sufferer, a carrying bag 36 is included for carrying the seizure pillow around. The carrying bag will have a pocket so that the seizure sufferer can carry a CPR mouthpiece. The carrying bag can have the appearance as shown in FIG. 4; however, it is not limited to this form and design.

When the seizure sufferer is away from home and at work or any other public place, they can carry the seizure pillow and have it ready for use. In the event of a seizure, a person standing by need only remove the seizure pillow from the carrying bag. While removing the pillow, simultaneously turn on the timing device positioned within the handle. By using the handle, the person assisting the seizing person guides the resilient pillow body under the head of the seizing person, being careful not to handle the person's head too much. If the person having the seizure moves their head, the handle is used to guide the seizure pillow as required with the movement of the seizing person's head. Once the seizure episode is complete, the timing device is turned off and the time is recorded. Once the seizure is stopped and the person is returned to a sitting or standing position, the timing device is reset, and the seizure pillow is returned to the carrying bag.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, equitably entitled.

What is claimed is:

1. A seizure pillow comprising, in combination:

a base member;

a handle portion interconnected to the base member and extending outwardly from a periphery thereof;

the handle of the base member has a timing device; and a resilient pillow body being positioned about a first portion of the base member, the resilient pillow body having a covering, the resilient pillow body being sized for receiving a seizing person's head.

2. The seizure pillow as set forth in claim 1, wherein the base member and handle are formed of a semi-rigid to rigid material that has a low specific gravity.

3. The seizure pillow as set forth in claim 2, wherein the material is a wood.

4. The seizure pillow as set forth in claim 2, wherein the material is a plastic.

5. The seizure pillow as set forth in claim 1, wherein the resilient pillow body has a raised central portion sloping downwardly toward an edge of the peripheral wall of the pillow body.

6. The seizure pillow as set forth in claim 1, wherein the resilient pillow body is made of a foam material selected from the group of foam material consisting essentially of urethane, polyurethane, polyethylene polyvinyl chloride, polyvinyl chloride/nitril blend, or synthetic sponge rubber.

7. The seizure pillow as set forth in claim 1, wherein the resilient pillow body is made of cotton.

8. The seizure pillow as set forth in claim 1, wherein the covering is made of a water repellant material.

9. The seizure pillow as set forth in claim 1, wherein the pillow is sized for carrying around in a carrying bag.

10. A method of using a seizure pillow with a person experiencing a seizure in a public place comprising the steps of:

removing the seizure pillow from a carrying bag, the seizure pillow including a base member, a handle portion interconnected to the base member, and extending outwardly from a periphery thereof, and a resilient pillow body being positioned about a first portion of the base member;

turning on a timing device positioned within the handle as the seizure pillow is removed from the carrying bag;

holding the handle of the seizure pillow and guiding the resilient pillow body under the head of the seizing person being careful not to handle the person's head too much;

moving the seizure pillow with the handle to guide the seizure pillow as required with the movement of the seizing person's head; and stopping the timing device when the seizure has stopped and recording the time, wherein once the seizure is stopped, and the person is returned to a sitting or standing position, the timing device is reset, and the seizure pillow is returned to the carrying bag.

11. The method of using the seizure pillow as set forth in claim 10, wherein the resilient pillow body having a covering.

12. The seizure pillow as set forth in claim 10, wherein the base member and handle are formed of a semi-rigid to rigid material that has a low specific gravity.

13. The seizure pillow as set forth in claim 12, wherein the material is a wood.

14. The seizure pillow as set forth in claim 12, wherein the material is a plastic.

15. The seizure pillow as set forth in claim 10, wherein the handle of the base member has a timing device.

16. The seizure pillow as set forth in claim 10, wherein the resilient pillow body has a raised central portion sloping downwardly toward an edge of the peripheral wall of the pillow body.

17. The seizure pillow as set forth in claim 10, wherein the resilient pillow body is made of a foam material selected from the group of foam material consisting essentially of urethane, polyurethane, polyethylene polyvinyl chloride, polyvinyl chloride/nitril blend, or synthetic sponge rubber.

18. The seizure pillow as set forth in claim 10, wherein the resilient pillow body is made of cotton.

19. The seizure pillow as set forth in claim 10, wherein the covering is made of a water repellant material.

* * * * *